US009168776B2

(12) United States Patent
Mantell et al.

(10) Patent No.: US 9,168,776 B2
(45) Date of Patent: Oct. 27, 2015

(54) METHOD OF INCREASING INK CRYSTALLIZATION

(71) Applicant: XEROX CORPORATION, Norwalk, CT (US)

(72) Inventors: David Allen Mantell, Rochester, NY (US); Paul McConville, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 324 days.

(21) Appl. No.: 13/919,800

(22) Filed: Jun. 17, 2013

(65) Prior Publication Data

US 2014/0370194 A1 Dec. 18, 2014

(51) Int. Cl.

| | |
|---|---|
| ***B05D 3/10*** | (2006.01) |
| ***B05D 1/36*** | (2006.01) |
| ***B41J 2/015*** | (2006.01) |
| ***B41M 5/00*** | (2006.01) |
| ***B41M 5/52*** | (2006.01) |

(52) U.S. Cl.

CPC ..... *B41M 5/0017* (2013.01); *B41M 5/0011* (2013.01); *B41M 5/5227* (2013.01)

(58) Field of Classification Search

CPC . B41M 5/0011; B41M 5/0017; B41J 11/0011
USPC ..... 427/301, 411, 326; 347/21
See application file for complete search history.

(56) References Cited

U.S. PATENT DOCUMENTS

| | | | | |
|---|---|---|---|---|
| 4,490,731 | A | 12/1984 | Vaught | |
| 4,889,560 | A | 12/1989 | Jaeger | |
| 4,889,761 | A | 12/1989 | Titterington | |
| 5,221,335 | A | 6/1993 | Williams | |
| 5,372,852 | A | 12/1994 | Titterington | |
| 5,621,022 | A | 4/1997 | Jaeger | |
| 6,471,348 | B1 * | 10/2002 | Koitabashi | 347/100 |
| 7,736,832 | B2 | 6/2010 | Farrugia | |
| 2011/0200797 | A1 * | 8/2011 | Mukai et al. | 428/195.1 |
| 2012/0272865 | A1 | 11/2012 | Morimitsu | |
| 2012/0274699 | A1 * | 11/2012 | Belelie et al. | 347/20 |
| 2012/0274716 | A1 * | 11/2012 | McConville et al. | 347/102 |

FOREIGN PATENT DOCUMENTS

JP 09175001 A * 7/1997

OTHER PUBLICATIONS

U.S. Appl. No. 13/456,619, by Naveen Chopra, filed Apr. 26, 2012.
U.S. Appl. No. 13/457,221, by Kentaro Morimitsu, filed Apr. 26, 2012.
U.S. Appl. No. 13/456,916, by Kentaro Morimitsu, filed Apr. 26, 2012.
U.S. Appl. No. 13/457,323, by Kentaro Morimitsu, filed Apr. 26, 2012.
U.S. Appl. No. 13/456,847, by Gabriel Iftime, filed Apr. 26, 2012.
U.S. Appl. No. 13/666,428 by Kentaro Morimitsu, filed Apr. 26, 2012.

* cited by examiner

*Primary Examiner* — Cachet Sellman
(74) *Attorney, Agent, or Firm* — Pillsbury Winthrop Shaw Pittman LLP

(57) ABSTRACT

The present embodiments relate to methods of increasing ink crystallization. In particular, there is provided a method for increasing the ink crystallization rate comprising providing a substrate; applying a first crystalline compound on the substrate to form a first layer; and printing an image using an ink comprises a second crystalline compound dispose on the first layer, wherein nucleation sites are formed between the first crystalline compound and the second crystalline compound.

20 Claims, 2 Drawing Sheets

METHOD OF INCREASING INK CRYSTALLIZATION

FIELD OF THE INVENTION

The present embodiments relate to methods of increasing or speeding up ink crystallization.

BACKGROUND

Ink jet printing processes may employ inks that are solid at room temperature and liquid at elevated temperatures. Such inks may be referred to as solid inks, hot melt inks, phase change inks and the like. For example, U.S. Pat. No. 4,490,731, the disclosure of which is totally incorporated herein by reference, discloses an apparatus for dispensing phase change ink for printing on a recording medium such as paper. In piezo ink jet printing processes employing hot melt inks, the phase change ink is melted by the heater in the printing apparatus and utilized (jetted) as a liquid in a manner similar to that of conventional piezo ink jet printing. Upon contact with the printing recording medium, the molten ink solidifies rapidly, enabling the colorant to substantially remain on the surface of the recording medium instead of being carried into the recording medium (for example, paper) by capillary action, thereby enabling higher print density than is generally obtained with liquid inks. Advantages of a phase change ink in ink jet printing are thus elimination of potential spillage of the ink during handling, a wide range of print density and quality, minimal paper cockle or distortion, and enablement of indefinite periods of nonprinting without the danger of nozzle clogging, even without capping the nozzles.

In general, phase change inks (sometimes referred to as "hot melt inks") are in the solid phase at ambient temperature, but exist in the liquid phase at the elevated operating temperature of an ink jet printing device. At the jetting temperature, droplets of liquid ink are ejected from the printing device and, when the ink droplets contact the surface of the recording medium, either directly or via an intermediate heated transfer belt or drum, they quickly solidify to form a predetermined pattern of solidified ink drops.

Phase change inks for color printing typically comprise a phase change ink carrier composition which is combined with a phase change ink compatible colorant. In a specific embodiment, a series of colored phase change inks can be formed by combining ink carrier compositions with compatible subtractive primary colorants. The subtractive primary colored phase change inks can comprise four component dyes or pigments, namely, cyan, magenta, yellow and black, although the inks are not limited to these four colors. Each of these subtractive primary colored inks can be formed by using a single dye or pigment or a mixture of dyes or pigments. For example, magenta can be obtained by using a mixture of Solvent Red Dyes or a composite black can be obtained by mixing several dyes. U.S. Pat. No. 4,889,560, U.S. Pat. No. 4,889,761, and U.S. Pat. No. 5,372,852, the disclosures of each of which are totally incorporated herein by reference, teach that the subtractive primary colorants employed can comprise dyes from the classes of Color Index (C.I.) Solvent Dyes, Disperse Dyes, modified Acid and Direct Dyes, and Basic Dyes. The colorants can also include pigments, as disclosed in, for example, U.S. Pat. No. 5,221,335, the disclosure of which is totally incorporated herein by reference. U.S. Pat. No. 5,621,022, the disclosure of which is totally incorporated herein by reference, discloses the use of a specific class of polymeric dyes in phase change ink compositions.

Phase change inks are desirable for ink jet printers because they remain in a solid phase at room temperature during shipping, long term storage, and the like. In addition, the problems associated with nozzle clogging as a result of ink evaporation with liquid ink jet inks are largely eliminated, thereby improving the reliability of the ink jet printing. Further, in phase change ink jet printers wherein the ink droplets are applied directly onto the final recording medium (for example, paper, transparency material, and the like), the droplets can solidify quickly upon contact with the recording medium, so that migration of ink along the printing medium is prevented and dot quality is improved.

While the above conventional phase change ink technology is successful in producing vivid images and providing economy of jet use and substrate latitude on porous papers, several challenges exist in regards to scarify ink solidification time with robustness. As such, there is a need to find alternative methods of printing to produce excellent image quality on substrates with satisfactory ink solidification time.

Each of the foregoing U.S. patents and patent publications are incorporated by reference herein. Further, the appropriate components and process aspects of the each of the foregoing U.S. patents and patent publications may be selected for the present disclosure in embodiments thereof.

SUMMARY

According to embodiments illustrated herein, there is provided methods of speeding up ink crystallization.

In particular, the present embodiments provide a method for increasing the ink crystallization rate comprising providing a substrate; applying a first crystalline compound on the substrate to form a first layer; and printing an image using an ink comprises a second crystalline compound dispose on the first layer, wherein nucleation sites are formed between the first crystalline compound and the second crystalline compound.

In embodiments, there is provided a method of increasing ink crystallization comprising providing a coated substrate comprising a substrate and a coating layer on the substrate, wherein the coating layer comprises a first crystalline compound; and printing an image on the coating layer using an ink comprises a second crystalline compound, wherein nucleation sites are formed between the first crystalline compound and the second crystalline compound.

In embodiments, there is provided a method for increasing ink crystallization comprising providing a substrate; applying a diurethane crystalline compound on the substrate to form a first layer; printing an image using a solid ink comprising the diurethane crystalline compound on the first layer.

BRIEF DESCRIPTION OF THE DRAWINGS

For a better understanding of the present embodiments, reference may be made to the accompanying figures.

DETAILED DESCRIPTION

In the following description, it is understood that other embodiments may be utilized and structural and operational changes may be made without departure from the scope of the present embodiments disclosed herein.

As used herein, a crystalline material or crystalline compound means a solid material, whose constituent atoms, molecules, or ions are arranged in an orderly repeating pattern extending in all three spatial dimensions.

As used herein, amorphous material or amorphous compound means a solid material which does not exhibit crystalline structure. That is, while there may be local ordering of the atoms or molecules, there is no long-term ordering thereof.

Embodiments of the present disclosure relate to methods of increasing ink crystallization. The methods include seeding or coating a substrate with a crystalline material (first crystalline compound) that may be the same or similar to the crystalline component (second crystalline compound) present in the ink used for printing. The crystallizing seeds significantly speed up the solidification time of the ink by eliminating the delay inherent in the initial crystallization step (i.e., primary nucleation), while maintaining the superior robustness properties of the ink. The crystallizing seeds thus allow the ink to be touched and/or spread within a reasonable time frame.

Prior to printing, a material comprises a first crystalline compound may be applied onto the surface of the substrate. Such material should be able to solidify quickly, and it may be clear or contain no colorant or may be white. Alternately, prior to printing, a first crystalline compound may be applied directly onto the surface of the substrate, or the substrate may be coated with a layer comprises a first crystalline compound.

Figure 2A:
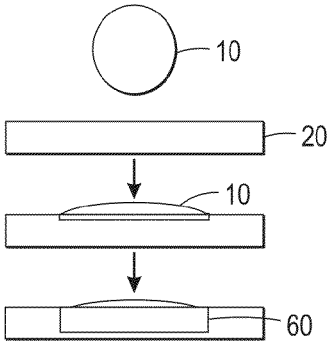
FIGS. 2A, 2B and 2C are diagrammatical illustrations of the concept of the method of increasing ink crystallization according to embodiments of the present disclosure.
Figure 2B:
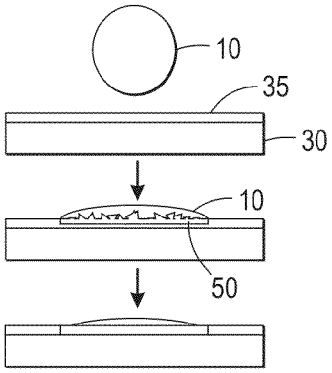
Figure 2C:
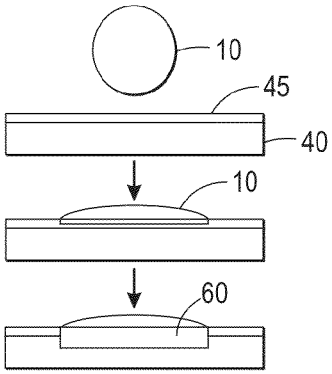

FIG. 2A illustrates an ink 10 being applied onto the surface of a non-coated substrate 20. The ink soaks into the substrate, and soak though 60 is visible from the back side of the substrate. FIG. 2B illustrates an ink 10 being applied onto the surface of a coated substrate 30. The coating 35 contains nucleation sites 50. After application of ink 10, ink crystallization occurs quickly in the coating and the ink remains on top of the substrate and is less visible from the back side of the substrate. FIG. 2C illustrates an ink 10 being applied onto the surface of a coated substrate 40. The coating 45 does not contain any nucleation site. Ink 10 soaks through the coating and the substrate, and the soak though 60 is visible from the back side of the substrate. It is possible that there is some reduction in visibility if the coating blocks diffusion of the ink into the substrate.

The first crystalline compound and the second crystalline compound of the present embodiments may be the same or similar in structure. In embodiments, the first crystalline compound is the same as the second crystalline compound.

In embodiments, both the first crystalline compound and the second crystalline compound belong to the same class of crystalline material selected from the group consisting of an ester of tartaric acid, an urethane, a diurethane, an amide, an aromatic ether, a sulfone, and an ester of an aliphatic linear diacid.

The first and second crystalline compounds of the present embodiments may include diurethane compounds and/or their derivatives. In embodiments, the first and second crystalline compounds include linear diurethanes. Suitable crystalline compound include those disclosed in U.S. patent application Ser. No. 13/456,619, entitled "Phase Change Ink Compositions Comprising Crystalline Diurethanes And Derivatives Thereof," which is hereby incorporated by reference in its entirety. These crystalline diurethanes are synthesized through one-step solvent-free reactions using commercially available linear diisocyanates with alcohols. This solvent-free process avoids any byproducts and has high reactor throughput. These crystalline materials have also been found to demonstrate good phase transition as well as have specific thermal and rheological properties that make the materials suitable for use in phase change inks.

The crystalline materials show sharp crystallization, relatively low viscosity (≤12 centipoise (cps), or from about 0.5 to about 20 cps, or from about 1 to about 15 cps) at a temperature of about 140° C., but very high viscosity (>$10^6$ cps) at room temperature. These materials have a melting temperature (Tmelt) of less than 150° C., or from about 65 to about 150° C., or from about 66 to about 145° C., and a crystallization temperature (Tcrys) of greater than 60° C., or from about 60 to about 140° C., or from about 65 to about 120° C. The ΔT between Tmelt and Tcrys is less than about 55° C.

These crystalline materials (i.e., the first crystalline compound and the second crystalline compound) may comprise diurethanes having a general formula:

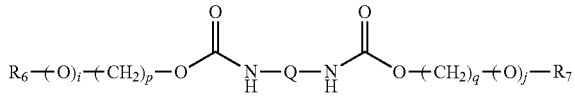

wherein Q is alkanediyl; each $R_6$ and $R_7$ is independently phenyl or cyclohexyl optionally substituted with one or more alkyl; i is 0 or 1; j is 0 or 1; p is 1 to 4; q is 1 to 4. In certain of such embodiments, each $R_6$ and $R_7$ is independently phenyl or cyclohexyl optionally substituted with one or more methyl or ethyl. In certain of such embodiments, $R_6$ and $R_7$ is phenyl. In certain embodiments, Q is —$(CH_2)_n$— and n is 4 to 8. In certain of such embodiments, n is 6.

The term "alkanediyl" refers to a divalent radical of an alkane group. Such alkanediyl has a general formula —Cn (RxRy)n-, where each Rx and Ry are independently a lower alkyl group or hydrogen.

In a specific embodiment, the first crystalline compound comprise dibenzyl hexane-1,6-diyldicarbamate.

Crystalline diurethane compounds can be synthesized by the general scheme shown below:

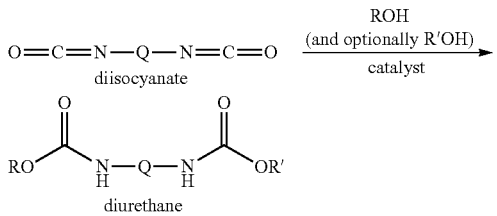

wherein Q is alkanediyl, R is —$(CH_2)_p$—$(O)_i$—$R_6$, and R' is —$(CH_2)_q$—$(O)_j$—$R_7$. In certain embodiments, Q is —$(CH_2)_n$—, and n is 4 to 8.

Suitable alcohols (ROH or R'OH) for use in the disclosure include but not limited to benzyl alcohol, 2-phenylethanol, 2-phenoxyethanol, 3-phenylpropan-1-ol, $C_6H_5(CH_2)_4OH$, cyclohexanol, 2-methylcyclohexanol, 3-methylcyclohexanol, 4-methylcyclohexanol, cyclohexylmethanol; 2-methylcyclohexylmethanol, 3-methylcyclohexylmethanol, 4-methylcyclohexylmethanol, and 4-ethylcyclohexanol. Each ROH and R'OH is independently selected from the listed disclosed above.

The above reaction may be conducted by combining diisocyanate and alcohol in the melt in the presence of a tin catalyst, such as, dibutyl tin dilaurate (Fascat 4202), dibutyl tin oxide (Fascat 4100); a zinc catalyst, such as Bi cat Z; or a bismuth catalyst, such as Bi cat 8124; Bi cat 8108. Only trace quantities of catalyst are required for the process. The relatively fast formation of diurethanes in a solvent-free process represents a significant improvement over the previous synthesis of crystalline components. In addition, the solvent-free process eliminates problems with byproducts and also means higher reactor throughput.

While not intending to be bound by theory, it is believed that the nature of the endgroup alcohol impacts the melt/crystallization properties of the resulting urethane formed. The function-hydrogen-bonding sites on the urethanes may offer stronger intermolecular forces than other crystalline components, such as diesters, for providing an ink capable of a more robust image.

In a specific embodiment, crystalline diurethane compounds having a linear six-carbon atoms core can be synthesized following the same reaction scheme:

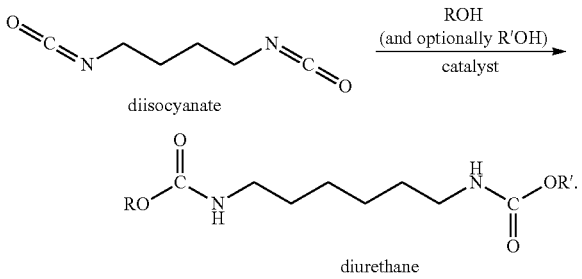

In one embodiment, benzyl alcohol is used with HDI (1,6-hexamethylenediisocyanate) to synthesize dibenzyl hexane-1,6-diyldicarbamate (herein as DHDC).

Examples of esters of tartaric acid includes dibenzyl L-tartrate, diphenethyl L-tartrate, bis(3-phenyl-1-propyl)L-tartrate, bis(2-phenoxyethyl)L-tartrate, diphenyl L-tartrate, bis(4-methylphenyl)L-tartrate, bis(4-methoxylphenyl)L-tartrate, bis(4-methylbenzyl)L-tartrate, bis(4-methoxyl benzyl)L-tartrate, dicyclohexyl L-tartrate, bis(4-tert-butylcyclohexyl)L-tartrate, and any stereoisomers and mixtures thereof.

Suitable crystalline components also include those disclosed in U.S. patent application Ser. No. 13/457,221 to Morimitsu et al., entitled "Phase Change Ink Comprising Crystalline Amides," which is hereby incorporated by reference in its entirety.

Suitable crystalline components also include those disclosed in U.S. patent application Ser. No. 13/456,916 to Morimitsu et al., entitled "Phase Change Ink Compositions Comprising Aromatic Ethers," which is hereby incorporated by reference in its entirety. Non-limited examples of crystalline aromatic ether include

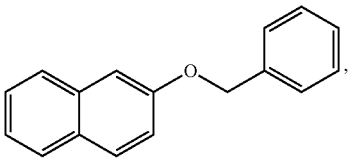

-continued

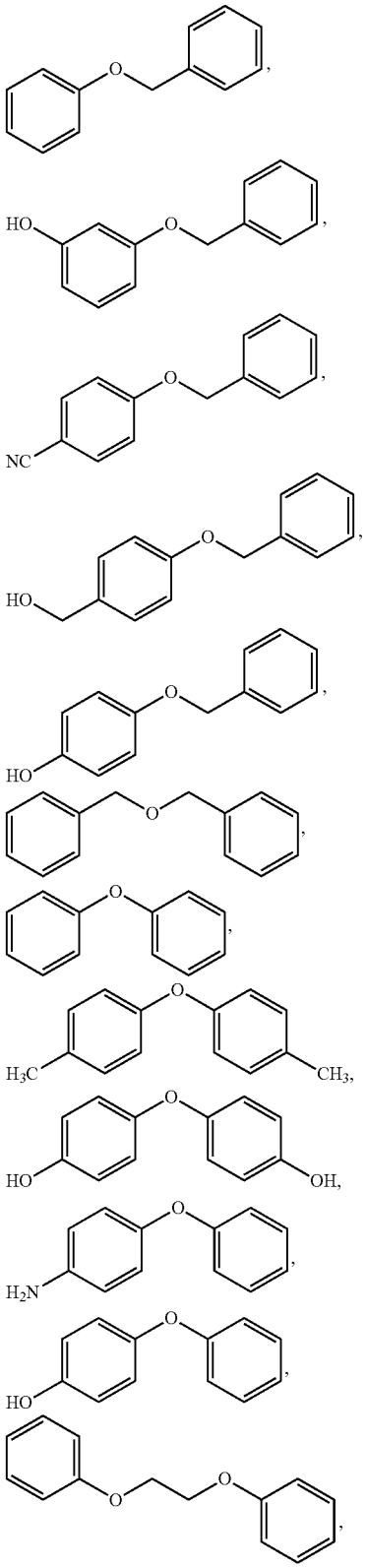

and mixtures thereof.

Suitable crystalline components also include those disclosed in U.S. patent application Ser. No. 13/457,323 to Morimitsu et al., entitled "Phase change ink Compositions Comprising Crystalline Sulfone Compounds and Derivatives Thereof" which is hereby incorporated by reference in its entirety.

Non-limited examples of crystalline sulfone include diphenyl sulfone, dimethyl sulfone, bis(4-hydroxyphenyl)sulfone, bis(4-aminophenyl)sulfone, bis(3-aminophenyl)sulfone, bis(4-chlorophenyl)sulfone, bis(4-fluorophenyl)sulfone, 2-hycroxyphenyl-4-hydroxyphenyl sulfone, phenyl-4-chlorophenyl sulfone, phenyl-2-aminophenyl sulfone, bis(3-amino-4-hydroxyphenyl)sulfone, dibenzyl sulfone, methylethyl sulfone, diethyl sulfone, methylisopropyl sulfone, ethylisopropyl sulfone, di-n-butyl sulfone, divinyl sulfone, methyl-2-hydroxymethyl sulfone, methylchloromethyl sulfone, sulfolane, 3-sulfolene, and mixtures thereof.

In embodiment, the first crystalline compound is present in an amount of from 10% to 85% based on the total weight of the coating layer. For coatings requiring significant amounts of pigments (e.g., 75-60 weight % of pigments), the first crystalline compound is present in an amount of from about 10% to about 30%, from about 10% to about 25%, 12% to about 22%, 15% to about 20%. For coatings not requiring large amounts of pigments (e.g., from about 30 to about 10 weight % of pigments), the first crystalline compound is present in an amount of from about 65% to about 85%, about 70% to about 80%, about 72% to about 78%.

There are two stages in the process of crystallization (or ink crystallization). The first stage is nucleation, where nucleation sites are formed leading to the formation of crystals. Nucleation occurs relatively slowly as the initial crystal components must impinge on each other in the correct orientation and placement for them to adhere and form the crystal. After crystal nucleation, the second stage of growth rapidly ensues. Thus, the time required for the process of crystallization is governed more by the first stage of nucleation than it is by the second stage of growth of crystallization. Accordingly, providing nucleation sites can significantly reduce the crystallization time.

In embodiments, the nucleation sites are formed between the first crystalline compound and the second crystalline compound.

In embodiments, the first crystalline compound forms a nucleation site for the second crystalline compound to promote ink crystallization.

In embodiments, the substrate comprises paper, plastic, metal, or fabric and any combination thereof.

Certain embodiments of the present disclosure provide a method of increasing ink crystallization (or increasing the rate of ink crystallization) including providing a coated substrate comprising a substrate and a coating layer on the substrate, wherein the coating layer comprises a first crystalline compound; and printing an image on the coating layer using an ink comprises a second crystalline compound.

In embodiments, the coating layer has a thickness of from about 5 microns to about 25 microns, from about 10 microns to about 25 microns, or from about 20 microns to about 25 microns.

The coating layer may further include one or more of pigments, binders, and/or additives.

The rate of ink crystallization may be measured using the TROM (Time-Resolved Optical Microscopy). TROM is described in U.S. patent application Ser. No. 13/456,847 entitled "Time Resolved Optical Microscopy ("TROM") Process For Measuring The Rate of Crystallization of Solid Inks" to Gabriel Iftime et al., electronically filed on the same day herewith.

TROM monitors the appearance and the growth of crystals by using Polarized Optical Microscopy (POM). The sample is placed between crossed polarizers of the microscope. Crystalline materials are visible because they are birefringent. Amorphous materials or liquids, similar to, for example, inks in their molten state that do not transmit light, appear black under POM. Thus, POM enables an image contrast when viewing crystalline components and allows for pursuing crystallization kinetics of crystalline-amorphous inks when cooled from the molten state to a set-temperature.

Standardized TROM experimental conditions were set, with the goal of including as many parameters relevant to the actual printing process. The key set parameters include:

(a) glass slides of a 16-25 mm diameter and a thickness comprise in between 0.2 mm to 0.5 mm.

(b) ink sample thickness comprised in a range from 5 to 25 microns (c) cooling temperature set at 40° C.

For rate of crystallization measurement, the sample is heated to the expected jetting temperature (viscosity=10-12 cps) via an offline hotplate and then transferred to a cooling stage coupled with an optical microscope. The cooling stage is thermostated at a preset temperature which is maintained by controlled supply of heat and liquid nitrogen. This experimental set-up models the expected drum/paper temperature onto which a drop of ink would be jetted in real printing process (40° C. for the experiments reported in this disclosure). Crystal formation and growth is recorded with a camera.

It should be understood that the crystallization times obtained with the TROM method for selected inks are not identical to what would be the crystallization times of a droplet of ink in an actual printing device. In an actual printing device such as a printer, the ink solidifies much faster. We determined that there is a good correlation between the total crystallization time as measured by the TROM method and the solidification time of an ink in a printer.

Figure 1:
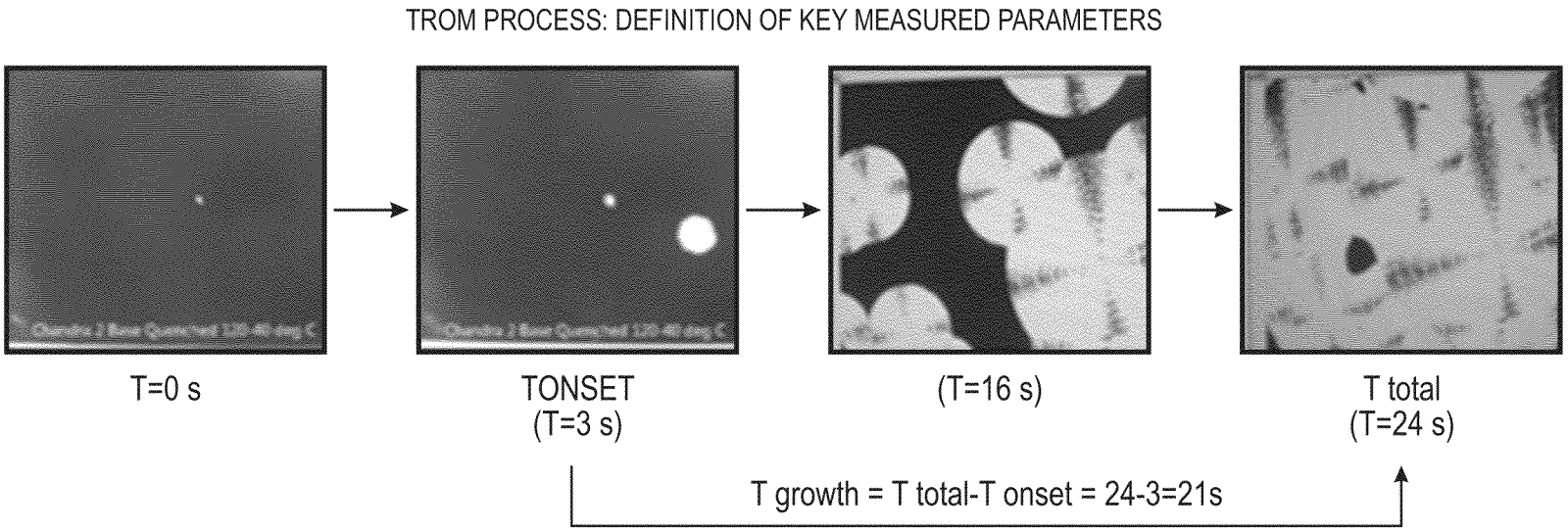
FIG. 1 illustrates the TROM process showing images of crystalline formation from crystallization onset to crystallization completion according to an embodiment of the disclosure.

The key steps in the TROM process are illustrated in FIG. 1, highlighting the key steps in the measuring process with the mainline ink base which contains just amorphous and crystalline components (no dye or pigment). When viewed under POM, the molten and at time zero, the crystalline-amorphous inks appear black as no light is passed through. As the sample crystallizes, the crystalline areas appear brighter. The numbers reported by TROM include: the time from the first crystal (crystallization onset) to the last (crystallization completion).

The definition of key measured parameters of the TROM process are set forth below:

Time zero (T=0 s)—the molten sample is placed on the cooling stage under microscope T onset=the time when the first crystal appears T growth=the duration of the crystal growth from the first crystal (T onset) to the completion of the crystallization (T total)

T total=T onset+T growth

Certain embodiments of the disclosure provide a method of increasing the rate of ink crystallization such that the time to crystallize may be reduced by as much as 30 seconds to about less than a second compared to a method employing a substrate without the presence of a first crystalline compound. In certain embodiments, the time to crystallize may be reduced by at least 1 second compared to a method employing a substrate without the presence of a first crystalline compound. In certain embodiments, the time to crystallize may be reduced by from about 5 seconds to about 0.1 seconds compared to a method employing a substrate without the presence of a first crystalline compound. In certain embodiments, the time to crystallize may be reduced by from about 3 seconds to about 0.5 seconds compared to a method employing a substrate without the presence of a first crystalline compound.

It will be appreciated that varies of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Example 1

Synthesis of dibenzyl hexane-1,6-diyldicarbamate

Into a 16 oz jar equipped with magnetic stir was charged 120 g benzyl alcohol (MW=108 g/mol, 1.11 mmol) and 10 drops of Fascat 4202 catalyst. The jar was placed in an about 130° C. oil bath. Next, 93.3 g HDI (MW=168 g/mol, 0.56 mmol) was added. An exotherm was observed. IR was checked after 1 hour of reaction and showed no isocyanate peak between 2200 and 2400 $cm^{-1}$, indicating that the reaction was complete. The reaction contents were poured into a tin pan to cool and solidify. DSC was employed to measure thermal properties of the materials. DHDC is a white powdered material having the following structure:

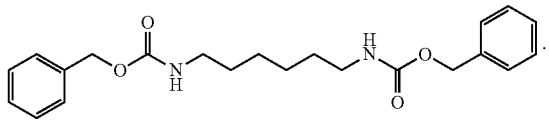

Example 2

Preparation of Ink

A phase change ink sample was prepared by using a 70:30 weight ratio blend of DHDC with di-D/L-menthyl L-tartrate (DMT), an amorphous material previously disclosed in U.S. patent application Ser. No. 13/095,784. The crystalline and amorphous materials were very miscible in this mixing ratio. A typical formulation example is given below:

| Component | Wt % | Mass/g |
|---|---|---|
| Crystalline material | 68.6 | 3.43 |
| DMT (amorphous) | 29.4 | 1.47 |
| Colorant (dye/pigment) | 2.0 | 0.1 |
| TOTAL | 100% | 5.0 g |

Example 3

Seeding of Substrate with a Crystalline Diurethane Material

A crystalline diurethane powdered material 1 (DHDC) was applied to uncoated paper. Then molten ink containing diurethane as the crystalline component was applied. The durethane crystals in the paper acts as nucleation sites for the ink. The ink then freezes quickly and does not soak deeply into the paper as it does with uncoated paper without applied DHDC. To test if the powdered diurethane mechanically blocked the ink rather than through the rapid formation of crystals a molten ink with a crystalline diester compound, rather than containing duethane, was applied. In this case the ink soaked deeply into the paper as it also did for uncoated paper.

Example 4

Seeding a Substrate with a Diester Crystalline Compound

The yellow version of an ink containing a diester crystalline compound was lightly applied to an uncoated paper by mechanical motion. Then drops of cyan and magenta ink were printed on the paper. On regions of the paper without yellow ink the drops spread out and soaked deeply into the paper. In regions where the cyan and magenta drops landed on the pre-applied yellow ink the cyan and magenta drops remained small and did not soak into the paper.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A method for increasing the ink crystallization rate comprising:

providing a substrate;

applying a first crystalline compound on the substrate to form a first layer; and printing an image using an ink comprises a second crystalline compound dispose on the first layer, wherein nucleation sites are formed between the first crystalline compound and the second crystalline compound.

2. The method of claim 1, wherein the first crystalline compound forms nucleation sites for the second crystalline compound.

3. The method of claim 1, wherein both the first crystalline compound and the second crystalline compound belong to the same class of crystalline material selected from the group consisting of an ester of tartaric acid, a urethane, a diurethane, an amide, an aromatic ether, a sulfone, and an ester of an aliphatic linear diacid.

4. The method of claim 1, wherein the first crystalline compound is the same as the second crystalline compound.

5. The method of claim 4, wherein both the first crystalline compound and the second crystalline compound comprise a diurethane.

6. The method of claim 1, wherein both the first crystalline compound and the second crystalline compound comprise a diurethane having the following formula:

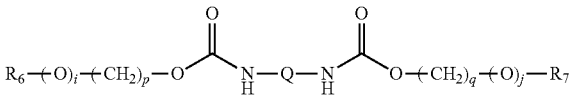

wherein Q is alkanediyl; each $R_6$ and $R_7$ is independently phenyl or cyclohexyl optionally substituted with one or more alkyl; i is 0 or 1; j is 0 or 1; p is 1 to 4; q is 1 to 4.

7. The method of claim 1, wherein the substrate comprises paper, plastic, metal, fabric or any combination thereof.

8. The method of claim 1, wherein the ink is phase change ink.

9. The method of claim 1, wherein a time for ink crystallization is decreased by at least 1 second compared to a method employing a substrate without the presence of a first crystalline compound.

10. A method of increasing the ink crystallization rate comprising:

providing a coated substrate comprising a substrate and a coating layer on the substrate, wherein the coating layer comprises a first crystalline compound; and printing an image on the coating layer using an ink comprising a second crystalline compound, wherein nucleation sites are formed between the first crystalline compound and the second crystalline compound.

11. The method of claim 10, wherein the first crystalline compound is the same as the second crystalline compound.

12. The method of claim 11, wherein the first crystalline compound and the second crystalline compound is a diurethane crystalline compound.

13. The method of claim 12, wherein the first crystalline compound is present in an amount of from 10% to 85% based on the total weight of the coating layer.

14. The method of claim 10, wherein the first crystalline compound forms a nucleation site for the second crystalline compound to promote ink crystallization.

15. The method of claim 10, wherein the coating layer has a thickness of from about 5 micron to about 25 microns.

16. The method of claim 10, wherein the ink is phase change ink.

17. A method for increasing ink crystallization comprising:

providing a substrate;

applying a diurethane crystalline compound on the substrate to form a first layer; and printing an image using a solid ink comprising the diurethane crystalline compound on the first layer.

18. The method of claim 17, wherein the diurethane crystalline compound having the following formula:

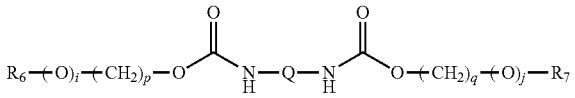

wherein Q is alkanediyl; each $R_6$ and $R_7$ is independently phenyl or cyclohexyl optionally substituted with one or more alkyl; i is 0 or 1; j is 0 or 1; p is 1 to 4; q is 1 to 4.

19. The method of claim 17, wherein the solid ink is phase change ink.

20. The method of claim 17, wherein the ink crystallization time is decreased by at least 1 second compared to a method employing a substrate without the presence of a first crystalline compound.

* * * * *